US007077274B2

(12) United States Patent
Laud

(10) Patent No.: US 7,077,274 B2
(45) Date of Patent: Jul. 18, 2006

(54) APPARATUS FOR HOLDING AND CARRYING SELECTED GOLF CLUBS

(76) Inventor: Jogerni (Joe) N. Laud, 11526 Clover La., Houston, TX (US) 77066

( * ) Notice: Subject to any disclaimer, the term of this patent is extended or adjusted under 35 U.S.C. 154(b) by 131 days.

(21) Appl. No.: 10/661,677

(22) Filed: Sep. 15, 2003

(65) Prior Publication Data

US 2005/0056603 A1 Mar. 17, 2005

(51) Int. Cl.
*A63B 55/00* (2006.01)

(52) U.S. Cl. ..... 211/70.2; 294/1; 294/143; D21/796

(58) Field of Classification Search ..... 211/70.2, 211/60.1; 206/315.2; 294/159, 1, 143; D21/796
See application file for complete search history.

(56) References Cited

U.S. PATENT DOCUMENTS 1,314,171 A * 8/1919 Vogel ..... 206/315.2
2,465,096 A * 3/1949 Hunt ..... 211/70.2
2,860,679 A * 11/1958 Kouke ..... 211/70.2
2,887,137 A * 5/1959 Robb ..... 211/70.2
2,938,559 A * 5/1960 Harkrader ..... 206/315.2
3,966,051 A * 6/1976 Hollister et al. ..... 211/14
4,154,274 A * 5/1979 Adamson ..... 206/315.2
4,371,022 A * 2/1983 Goulart ..... 294/137
5,238,109 A * 8/1993 Smith ..... 206/315.2
5,314,079 A * 5/1994 Young ..... 211/70.2
5,984,395 A * 11/1999 Halpen ..... 294/143
6,383,088 B1 * 5/2002 Kershner ..... 473/282
6,640,970 B1 * 11/2003 Townsend, Jr. ..... 206/315.2
2004/0026279 A1 * 2/2004 Miller ..... 206/315.2

* cited by examiner

*Primary Examiner*—Blair M. Johnson
(74) *Attorney, Agent, or Firm*—Bill B. Berryhill

(57) ABSTRACT

Apparatus removably engageable with a golf bag for holding and carrying two or more selected golf clubs from the golf bag. The apparatus includes two or more tubular members substantially shorter than the golf clubs joined together in parallel relationship opened at each end and through which the shafts of selected golf clubs may be inserted. An elongated handle member is attached near one end of the tubular members and extends in spaced parallel relationship therewith toward a free distal end.

2 Claims, 3 Drawing Sheets

APPARATUS FOR HOLDING AND CARRYING SELECTED GOLF CLUBS

BACKGROUND OF THE INVENTION

1. Field of the Invention

The present invention pertains to golf apparatus. More particularly, the present invention pertains to apparatus for removable engagement with a golf bag for holding and carrying two or more selected golf clubs from the golf bag.

2. Description of the Prior Art

In the game of golf, the typical golfer uses many golf clubs each one of which is designed for a different purpose. There are drivers for driving the ball great distances down the fairways. There are various irons for particular purpose and each set normally contains at least one putter for the final shots on the greens. Nearing the putting green shots may include putting, chipping, pitching, bump and run, and bunker shots. A variety of especially designed clubs are provided for these shots. These areas are sometimes referred to as the "short game".

A complete set of golf clubs is quite cumbersome and heavy. Typically a set of clubs is placed in a golf bag in which the clubs are carried over the golf course. The bag and set of golf clubs could then be carried on a power cart, a manual push cart or by a caddy or the golfer himself.

When the golfer approaches the green, in the "short game", it may not be practical or allowed to use a golf cart. In the short game, the golfer may use a putter and two or three other clubs. He may not want to take the entire golf bag and set of clubs with him. However, if he brings two or three clubs with him the non-used clubs may be laid on the ground while executing his shot. The non-used clubs may be stepped on or contaminated with dirt and moisture and sometimes even lost or left behind.

In an attempt to overcome the aforementioned problems, various devices have been designed to assist in carrying selected golf clubs without having to carry a golf bag and an entire set of clubs. Examples of such are shown in U.S. Pat. Nos. 3,966,051; 4,154,274 and 5,188,243. Since these devices are not designed to carry an entire set of clubs, the golfers selection of clubs is somewhat limited. In U.S. Pat. No. 5,984,395 such a device is also adapted for attachment to a golf bag in which an entire set of clubs might be transported and then removed for separate transportation during the short game. However, this device is heavy, cumbersome and not easily manufactured. More suitable solutions are desired and sought.

SUMMARY OF THE PRESENT INVENTION

The present invention provides apparatus which is removably engageable with a golf bag for holding and carrying two or more selected golf clubs from the golf bag. Thus, the putter and two or more clubs necessary for the short game may be removed from the golf bag and easily carried toward the greens without having to transport the entire set of golf clubs.

The apparatus of the present invention comprises two or more tubular members, shorter than the golf clubs, which are joined in a parallel relationship and opened at both ends. The proximal end of an elongated handle is attached near one end of the tubular members and extends in a spaced parallel relationship therewith toward a free distal end. The distal end of the handle may then be inserted into a golf bag for easy removal therefrom. At least two of the tubular members are arranged in their relationship so that they form a base which, when the apparatus is carried with golf clubs inserted therein, may be laid on the ground with the base supporting the apparatus on the ground. Variations of the preferred embodiment will also be described.

Thus, the apparatus of the present invention, which is engageable with a golf bag, permits the holding and carrying of two or more selected golf clubs from the golf bag so that it is not required to carry the entire set of golf clubs in the short game. The apparatus is extremely light and easily removable from the golf bag. It's unique construction results in reduced manufacturing cost and affordability to the user. Many other objects and advantages of the invention will be apparent from reading the description which follows in conjunction with the accompanying drawings.

DESCRIPTION OF PREFERRED EMBODIMENTS

Figure 1:
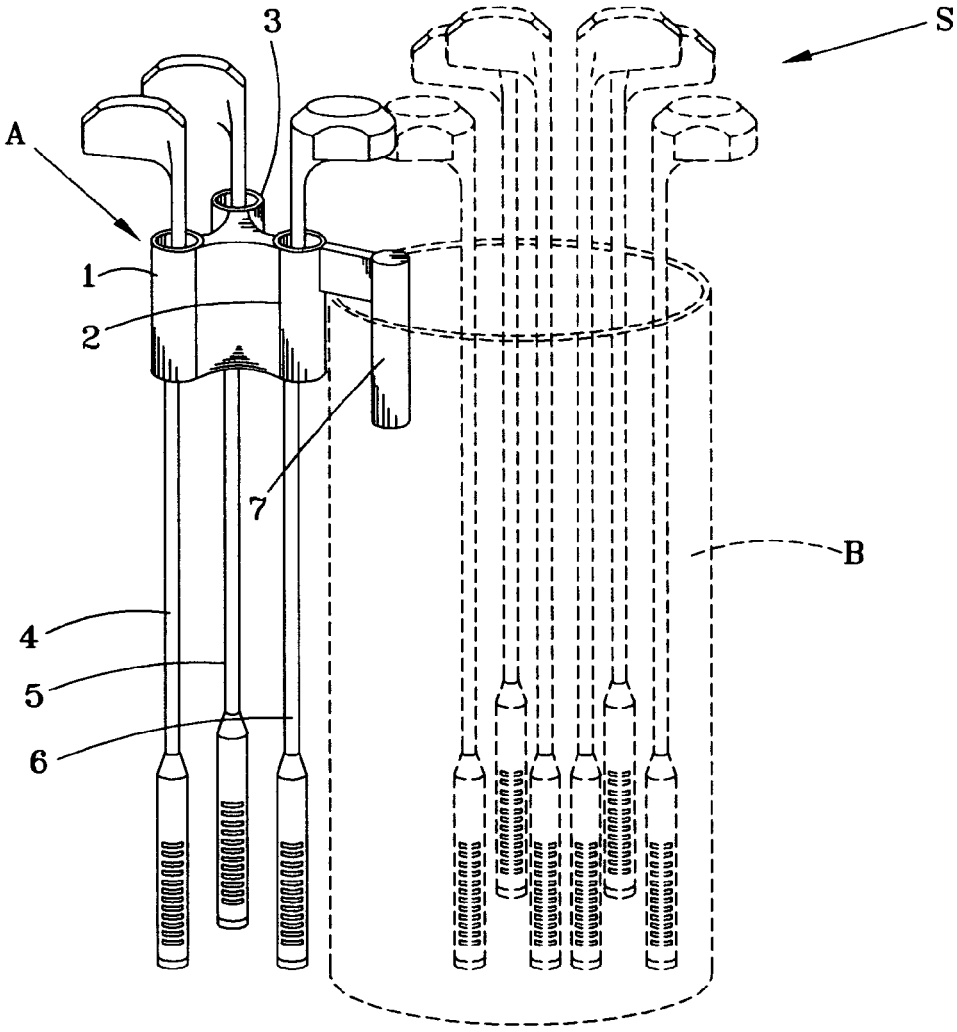
FIG. 1 is a pictorial representation of the golf club holding and carrying apparatus of the present invention shown engaged with a golf bag.
Figure 5:
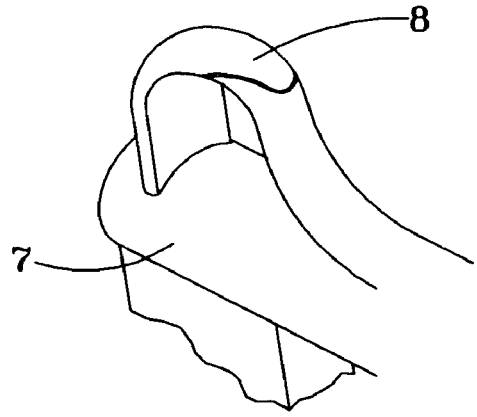
FIG. 5 is an isometric view of the upper portion of the handle of the present invention.
Figure 4:
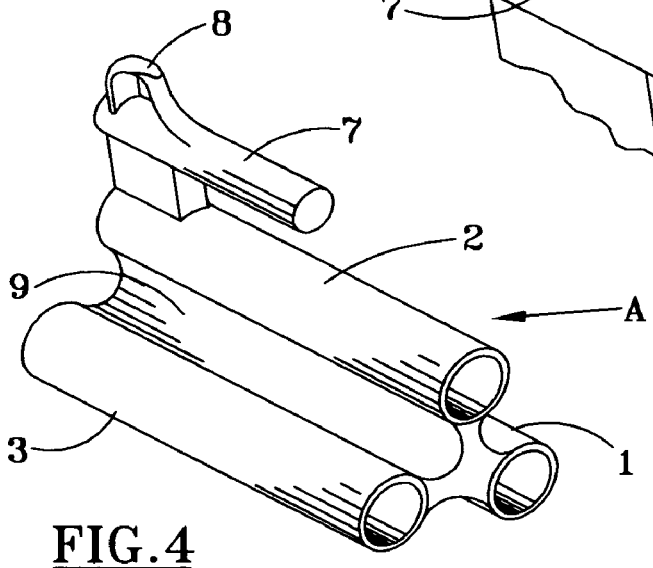
FIG. 4 is an isometric view of the apparatus of the present invention as viewed from the bottom thereof.

Referring first to FIG. 1, there is shown a golf bag B in which is carried a set of golf clubs S. Removably engageable with the golf bag B is the apparatus A of the present invention for holding and carrying two or more selected golf clubs from the golf bag B. In the preferred embodiment of FIGS. 1–5, the apparatus A comprises three tubular members, 1, 2, 3 substantially shorter than golf clubs joined together in a parallel relationship. The tubular members 1, 2, 3 are opened at each end allowing insertion of the shafts of selected golf clubs such as the clubs 4, 5 and 6 shown in FIGS. 1 and 2. An elongated handle member 7 is attached at the proximal end thereof near an upper end of one of the tubular members 2. The handle member extends in a spaced parallel relationship with the tubular members 1, 2 and 3 toward a free distal end which may be inserted into the golf bag B for removable engagement therewith. However, in the preferred embodiment, the handle member 7 may be provided with a clip portion 8, as best shown in FIG. 5, which may be utilized to removably engage a ring or loop or the like provided on the golf bag. It is preferable that the tubular members 1, 2, 3 and the handle member 7 all be formed as a single unit of uniform material, such as a suitable plastic. In such forming, the tubular members 1, 2 and 3 may be joined by an interconnecting elongated web portion 9.

Figure 2:
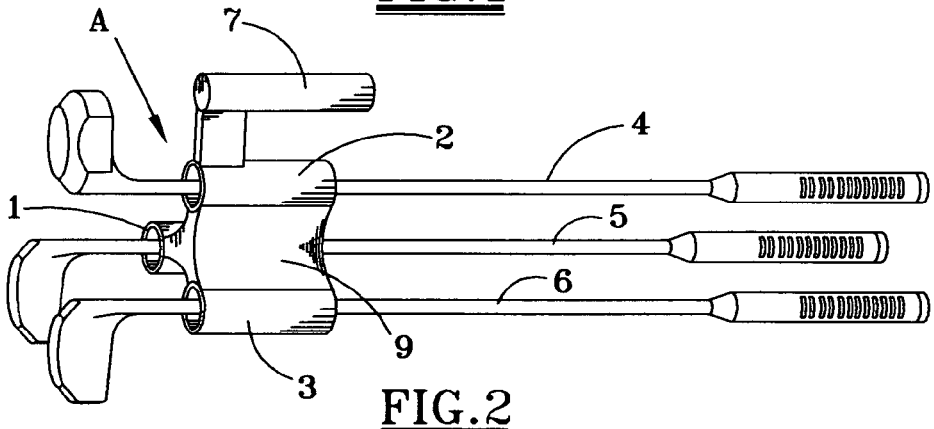
FIG. 2 is a pictorial view of the apparatus of the present invention as it would be separated from the golf bag and laid on the ground with two or more golf clubs carried thereby.
Figure 3:
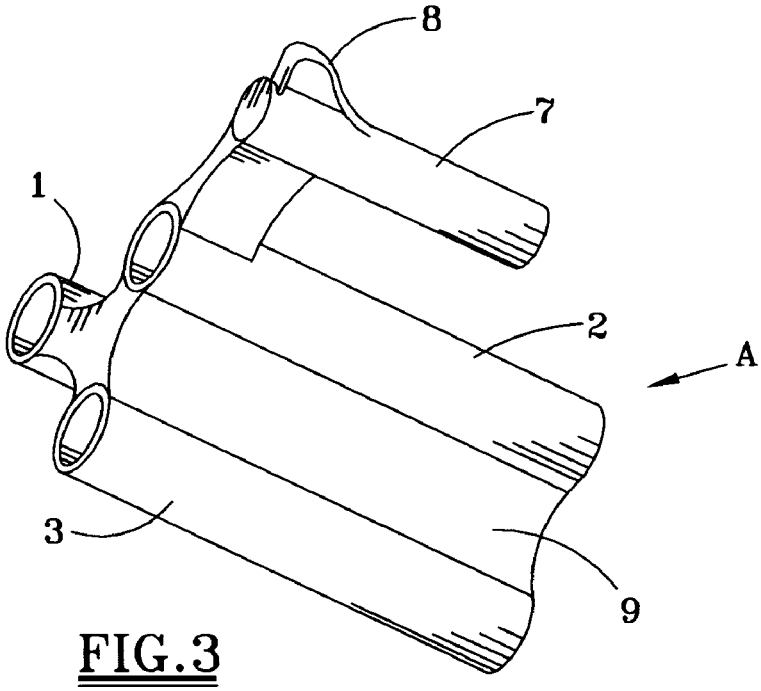
FIG. 3 is an isometric view of the apparatus of the present invention as viewed from the top thereof.

Although the apparatus A may be constructed of two or more tubular members, the preferred embodiment comprises three tubular members which, in cross section, are arranged in triangular relationship, two of the members 1 and 3 forming a base and the other member 2 the apex of the triangular relationship. The handle member 7 is attached to the tubular member 2 so that the apparatus A, with the selected golf clubs inserted into the tubular members, may be removed from the golf bag and carried by its handle 7 and laid on the ground, such as shown in FIG. 2, so that the tubular members 1 and 3 form the base of the triangular relationship to support the apparatus A and the clubs 4, 5, 6 on the ground.

Figure 6:
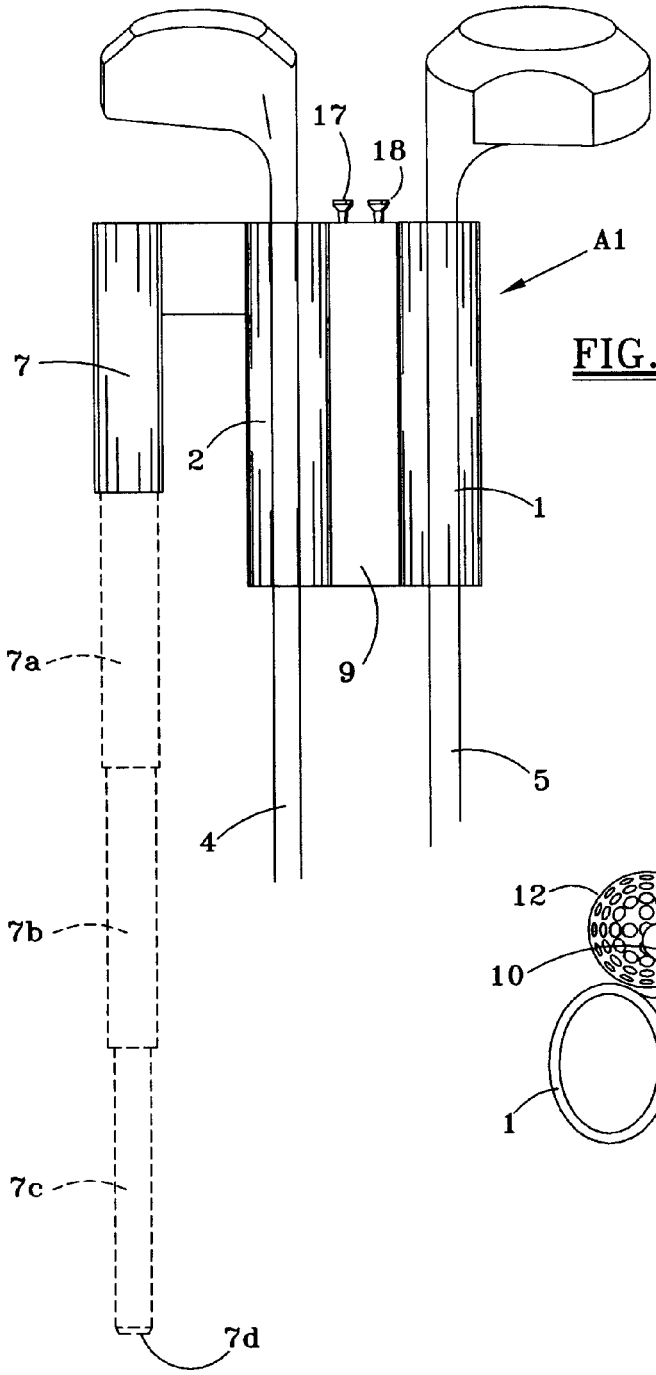
FIG. 6 is a longitudinal view of an alternate embodiment of the apparatus of the present invention.
Figure 7:
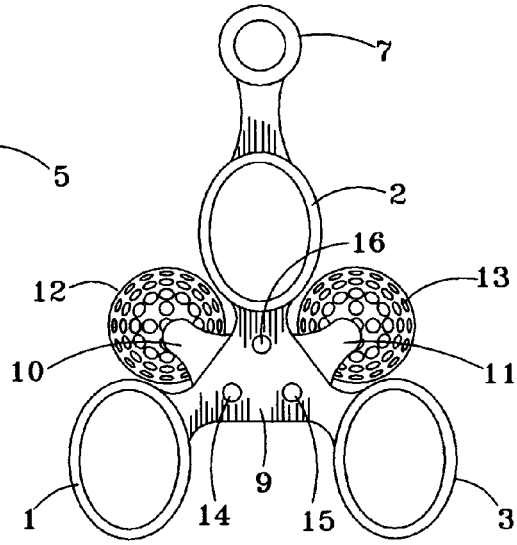
FIG. 7 is a top view of the alternate embodiment of FIG. 6.

FIGS. 6 and 7 illustrate an alternate embodiment of the invention with some added features which may be preferred by some golfers. As shown in FIG. 6, the apparatus $A_1$ is essentially the same as the apparatus of FIGS. 1–5 having three tubular members 1, 2 and 3 joined by an interconnecting web 9 and provided with a handle member 7. However, the handle member 7 is tubular and provided therein with two or more, in the present embodiment three, telescoping sections 7*a*, 7*b* and 7*c* which may be extended to the length illustrated in FIG. 6, a length substantially the same as the length of a golf club shaft. Thus with golf clubs inserted into the tubular members 1, 2 and 3, the ends of the golf club shafts and the lower end 7*d* of the extended telescopic handle 7 may support the apparatus A and the golf clubs 4, 5, 6 in an upright or vertical position.

In addition, it will be noted that in providing the interconnecting web 9 between the tubular members 1, 2 and 3, elongated recesses are provided therebetween. At least one of these recesses (see FIG. 7) may be provided with one or more clip type holders 10, 11 in which one or more golf balls 12, 13 may be removably carried. In addition, the top of the web portion 9 may also be provided with small holes 14, 15, 16 for receiving golf tees. See 17 and 18 in FIG. 6.

Thus the present invention provides apparatus which is removably engageable with a golf bag for holding and carrying two or more selected golf clubs from the golf bag so that, particularly in the short golf game, it is not necessary to carry or transport the golf bag and an entire set of golf clubs as a golfer approaches the greens. The apparatus is easily engaged and removed from the golf bag and provided with a convenient handle by which the apparatus and the selected golf clubs may be carried toward the greens. In the preferred embodiment, the lower tubular members form a base which supports the apparatus and the selected golf clubs horizontally on the ground. In an alternate embodiment, the handle may be extended cooperating with golf club shafts to support the apparatus and golf clubs in a vertical position. Additional features are provided for carrying golf balls and golf tees.

Although the apparatus of the present invention is designed primarily for removable engagement with a golf bag it may be used simply to carry two or more golf clubs to a practice driving range or green without having to transport the golf bag and entire set of clubs therewith.

Although two embodiments of the invention have been described herein, many variations may be made therefrom without departing from the spirit of the invention. Accordingly, it is intended that the scope of the invention be limited only by the claims which follow.

The invention claimed is:

1. Apparatus removably engageable with a golf bag for holding and carrying selected golf clubs from said golf bag, said apparatus comprising:

three tubular members substantially shorter than any golf clubs to be carried thereby and joined together in parallel relationship, opened at each end and through which the shafts of said selected golf clubs may be inserted, said tubular members, in cross-section, being arranged in triangular relationship, two forming a base and one the apex of said apparatus; and an elongated handle member having a proximal end attached near one end of said tubular member which forms said apex and extending in spaced parallel relationship therewith toward a free distal end which may be inserted into said golf bag for said removable engagement of said apparatus with said golf bag and allowing said apparatus, with said selected golf clubs inserted into said tubular members, to be carried by said handle and laid on the ground so that said two tubular members which form said base support said apparatus on the ground, said handle member also being telescopically extendable from a retracted position of a length substantially the same as said tubular members to a extended position of a length substantially the same as shafts of said selected golf clubs allowing said apparatus and said selected golf clubs carried thereby to be supported by said handle and the ends of said selected golf clubs in a vertical disposition.

2. Apparatus removably engageable with a golf bag for holding and carrying selected golf clubs from said golf bag, said apparatus comprising:

three tubular members substantially shorter than any golf clubs to be carried thereby and joined together in parallel relationship, opened at each end and through which the shafts of said selected golf clubs may be inserted, said tubular members, in cross-section, being arranged in triangular relationship, two forming a base and one the apex of said apparatus, said tubular members being joined by interconnecting webs forming elongated recesses therebetween, at least one of said recesses being provided with one or more holders in which one or more golf balls may be removably carried; and an elongated handle member having a proximal end attached near one end of said tubular members and extending in spaced parallel relationship therewith toward a free distal end which may be inserted into said golf bag for said removable engagement of said apparatus with said golf bag.

* * * * *